United States Patent [19]

Tachibana et al.

[11] Patent Number: 4,893,146

[45] Date of Patent: Jan. 9, 1990

[54] PAPER SEPARATING CLAW FOR IMAGE FORMING APPARATUS

[75] Inventors: Natsuki Tachibana, Yokohama; Kenshi Toshimitsu, Kawasaki; Issey Ichihara, Funabashi, all of Japan

[73] Assignee: Kabushiki Kaisha Toshiba, Kawasaki, Japan

[21] Appl. No.: 273,158

[22] Filed: Nov. 18, 1988

Related U.S. Application Data

[63] Continuation of Ser. No. 110,876, Oct. 21, 1987, abandoned.

[30] Foreign Application Priority Data

Oct. 31, 1986 [JP] Japan ..... 61-259714
Oct. 31, 1986 [JP] Japan ..... 61-259724

[51] Int. Cl.[4] ..... G03G 15/00

[52] U.S. Cl. ..... 355/315; 271/308; 271/900

[58] Field of Search ..... 355/3 SH, 3 R, 3 TR; 271/900, 307, 308, 311, 312

[56] References Cited

U.S. PATENT DOCUMENTS 3,918,702 11/1975 Mihalik et al. ..... 271/174
4,060,320 11/1977 Doi et al. ..... 271/900
4,124,289 11/1978 Miyata et al. ..... 355/8 X
4,336,992 6/1982 Szlucha et al. ..... 355/3 FU
4,387,981 6/1983 Cormier ..... 355/3 SH
4,478,506 10/1984 Yoshitake et al. ..... 355/3 TR

*Primary Examiner*—R. L. Moses
*Attorney, Agent, or Firm*—Foley & Lardner, Schwartz, Jeffery, Schwaab, Mack, Blumenthal & Evans

[57] ABSTRACT

An image forming apparatus includes a movable image carrier, an image forming device for forming an image on the image carrier, and a transferring device for transferring the image from the image carrier onto an image bearing sheet while the image bearing sheet is in contact with the surface of image carrier. The apparatus also includes a separating claw having a tip for contact with the surface of the image carrier for separating the image bearing sheet from the image carrier, and a moving mechanism for moving the separating claw between a first position in which the tip of separating claw is in contact with the surface of the image carrier and a second position in which the separating claw is separated from contact with the surface of the image carrier. The separating claw includes an elastic synthetic resin composition containing a polyurethane resin.

11 Claims, 4 Drawing Sheets

PAPER SEPARATING CLAW FOR IMAGE FORMING APPARATUS

This application is a continuation of application Ser. No. 110,876, filed October 21, 1987 abandoned.

BACKGROUND OF THE INVENTION

1. Field of the Invention

The present invention relates to an image forming apparatus, and more particularly to separation devices for removing an image bearing sheet from an image carrier in an image forming apparatus.

2. Description of the Related Art

Conventionally, in a typical image forming apparatus, electrostatic copiers, a transfer charger and a separation charger are arranged around a photosensitive body. After transferring a developed image from the photosensitive body onto a copy sheet while the copy sheet is in contact with the photosensitive body by action of the transfer charger, the copy sheet is separated from the photosensitive body by action of the separation charger. However, occasionally the copy sheet cannot be separated completely from the photosensitive body because an insufficient charge is applied by the separation charger to the copy sheet. In this case, the non-separated copy sheet unfortunately can infiltrate into a cleaning device and cause a jam. For preventing the above-mentioned problem, conventionally, a separating claw is arranged against the photosensitive body to physically remove the copy sheet before the sheet reaches the cleaning device.

For the separating claw which constitutes this type of separation device, usually a hard plastic, such as ABS resin or Delrin (a trade name of Du Pont Co. for an acetal resin), and an elastic film, such as Mylar (a trade name of Du Pont Co. for a polyester film) have been used. By causing the sharp tip of the separating claw to make contact with the surface of the photosensitive body at an appropriate time, the copy sheet can be separated from the photosensitive body after passing the transfer charger and separation charger. The separating claw provides an auxiliary mechanism to prevent the copy sheet from entering the cleaning device and causing a jam.

However, in the above conventional separating claw, and particularly in one made of a plastic such as ABS resin, the hardness often is too high. For this reason, the surface of the photosensitive body, which normally is formed of a comparatively soft material like selenium (Se), can be easily damaged by this contact with the photosensitive body. Therefore, problems occur in that the picture quality of the developed image may become poor.

In order to compensate for the above problems, a soft film such as Mylar has been used for the separating claw. When Mylar is used, there has to be a complex construction in which a harder material is used as a base member, in order to maintain the accuracy and configuration of the Mylar portion, which makes contact with the photosensitive body. Accordingly, construction of the separation claw becomes complex, more expensive and time consuming. In addition, the surface of the photosensitive body may be easily damaged by contact with the harder portions of the separating claw construction. Another problem, which sometimes arises, relates to the electrostatic attraction of the copy sheet to the photosensitive body. If the contact pressure of the claw on the surface of the photosensitive body is too low, the copy sheet may more easily enter the cleaning device without separating from the photosensitive body. Thus a breakdown of the cleaning device or the apparatus may result.

SUMMARY OF THE INVENTION

It is an object of the present invention to provide an image forming apparatus in which reliable separation of an image bearing sheet from the surface of an image carrier can be achieved without damaging the surface of the image carrier.

Another object of the invention is to better protect the surface of an image carrier in an image forming apparatus during removal of image bearing sheets from the carrier.

According to one aspect of the present invention, there is provided an image forming apparatus including a movable image carrier, means for forming an image on the image carrier, and means for transferring the image from the image carrier onto an image bearing sheet while the image bearing sheet is in contact with the surface of image carrier, the apparatus comprising means for separating the image bearing sheet from the image carrier, including a separating claw having a tip for contact with the surface of the image carrier, the separating claw including an elastic synthetic resin composition containing a polyurethane resin; and means for moving the separating claw between a first position in which the tip of the separating claw is in contact with the surface of the image carrier and a second position in which the separating claw is separated from contact with the surface of the image carrier.

It is preferred that the elastic synthetic resin composition includes one of a copolymer of the polyurethane resin and a silicon system resin, a copolymer of the polyurethane resin and a fluorocarbon system resin, a dispersed system of the polyurethane resin and a silicon system resin, and a dispersed system of the polyurethane resin and a fluorocarbon system resin.

BRIEF DESCRIPTION OF THE DRAWINGS

These and other objects and advantages of this invention will become more apparent and more readily appreciated from the following detailed description of the presently preferred exemplary embodiments, taken in conjunction with the accompanying drawing of which.

DETAILED DESCRIPTION OF THE PREFERRED EMBODIMENTS

The following is a detailed description of an embodiment of the present invention with reference to the drawings.

Figure 1:
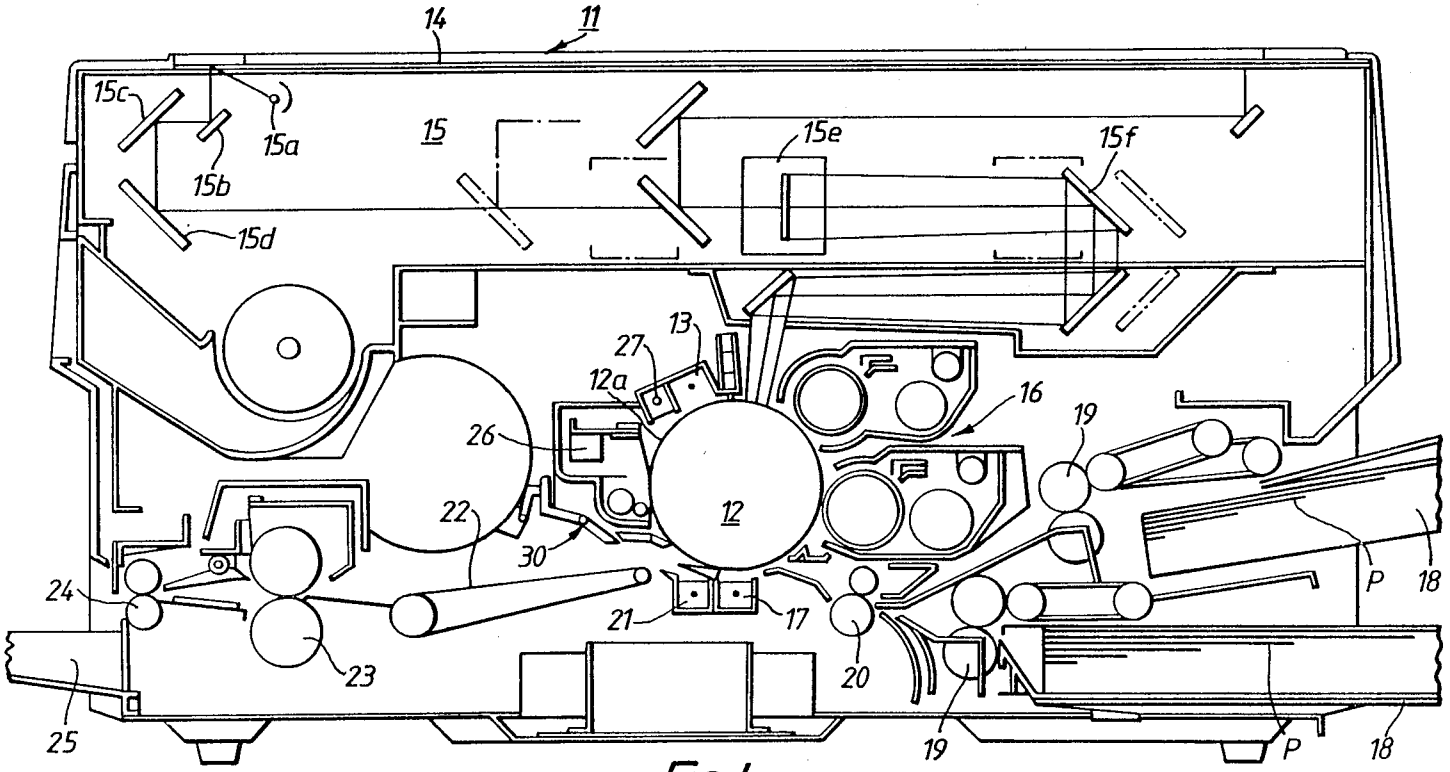
FIG. 1 is a configurational diagram showing an electrostatic copier including an image forming apparatus according to the present invention.

FIG. 1 shows an outline of the internal structure of an electrostatic copier which is an image forming apparatus of the present invention. A drum-shaped photosensitive body 12 is rotatably provided approximately in the center of a housing 11. This photosensitive body 12 is designed to be uniformly charged by a main charger 13. An original document table 14 made of transparent glass is provided at upper position of housing 11. An electrostatic latent image of an original document (not shown) placed on original document table 14, is formed on a surface 12a of photosensitive body 12 via an optical device 15. Optical device 15 comprises an exposure lamp **15*a*, first, second and third reflecting mirrors 15*b*, 15*c* and 15*d*, a l ens 15*e* and fourth reflecting mirror 15*f*. The electrostatic latent image is converted into a developed image by a developing agent accommodated in a developing device 16. While a copy sheet P has been transported to a transfer charger 17 from paper supply cassettes 18 via paper supply rollers 19 and aligning rollers 20. At the position of transfer charger 17, the developed image is transferred from photosensitive body 12 onto copy sheet P by the action of transfer charger 17. Copy sheet P is then separated from photosensitive body 12 by the action of a separation charger 21**.

After developed image transferring and separating, copy sheet P is transported through a conveying belt 22 to a fixing device 23 comprising a pair of heat rollers for fixing the developed image on copy sheet P. Copy sheet P is then dispensed into a receiving tray 25 by exit rollers 24.

After the transfer of the developed image onto copy sheet P and separation of copy sheet P from photosensitive body 12, the developing agent remaining on the surface **12*a* of photosensitive body 12 is cleaned off by a cleaning device 26. The potential on photosensitive body 12 is reduced to a specified level by a discharging lamp 27** and it is returned to a condition in which the next copying operation can be carried out.

Figure 7:
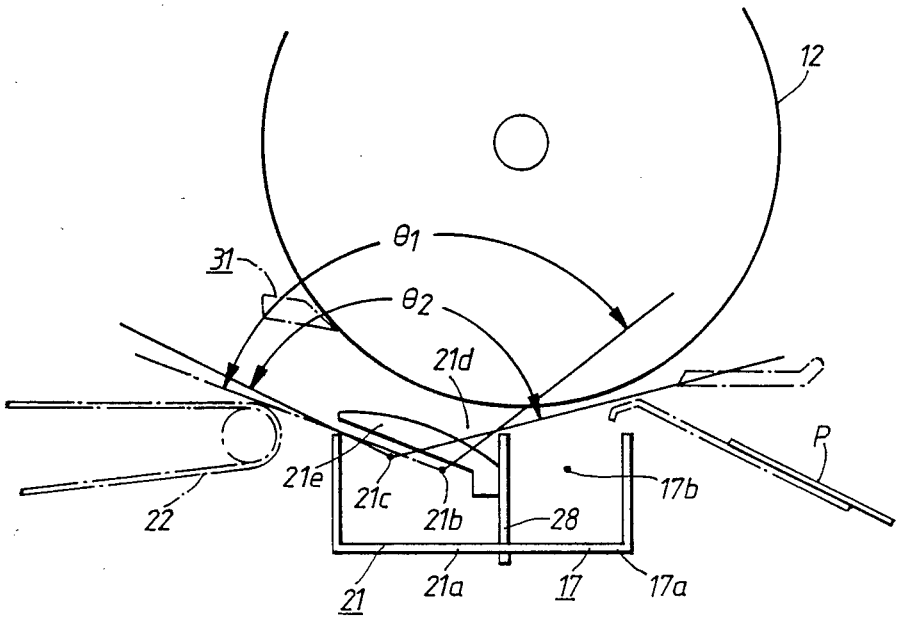
FIG. 7 is a schematic diagram showing the configuration of a transfer charger and separation charger.

FIG. 7 shows transfer charger 17 and separation charger 21 in detail. A shielding case **21*a* has an opening 21*d* facing the surface of photosensitive body 12. First and second charging wires 21*b* and 21*c* are strung inside shielding case 21*a* along the longitudinal direction of shielding case 21*a*. Each of first and second charging wires 21*b* and 21*c* is made of tungsten wire of diameter 80 μm. Shielding case 21*a* is constructed so that it is incorporated with a shielding case 17*a* of transfer charger 17. Separation charger 21 is functionally separated from transfer charger 17 by a dividing plate 28. A guide plate 21*e* is mounted in shielding case 21 to guide the transportation of copy sheet P. A charging wire 17*b* is strung in shielding case 17*a* along longitudinal direction of shielding case 17*a***.

Second charging wire **21*c*, which is positioned to the rear in relation to the direction of advance of copy sheet P, is strung in a position which is displaced higher than first charging wire 21*b* in the front position. The distances of these two charging wires 21*b* and 21*c* from photosensitive body 12 are almost equal. The discharge field produced by second charging wire 21*c* (a zone shown by an aperture angle $\theta 2$) is set wider than the discharge field produced by first charging wire 21*b* (a zone shown by an aperture angle $\theta 1$). The voltage applied to second charging wire 21*c* is set lower than the voltage applied to first charging wire 21*b***.

The functions of two charging wires **21*b* and 21*c* strung inside shielding case 21*a* are divided. First charging wire 21*b* positioned in front in relation to the direction of advance of paper P, acts to separate copy sheet P from photosensitive body 12. Second charging wire 21*c* positioned farther away, acts to electrostatically discharge copy sheet P. Since the discharge field of charging wire 21*c* is made wider, it can electrostatically discharge copy sheet P gradually. Thus the electrostatic discharging of copy sheet P is not carried out rapidly as in prior art, and so the problem of the toner on copy sheet P returning to photosensitive body 12** does not arise.

As shown in FIG. 1, a separation device 30 is arranged approximately in the middle in the longitudinal direction of photosensitive body 12 between separation charger 21 and cleaning device 26. separation device 30 acts to separate copy sheet P from photosensitive body 12 when copy sheet P cannot be separated from photosensitive body 12 by the action of separation charger 21.

Figure 2:
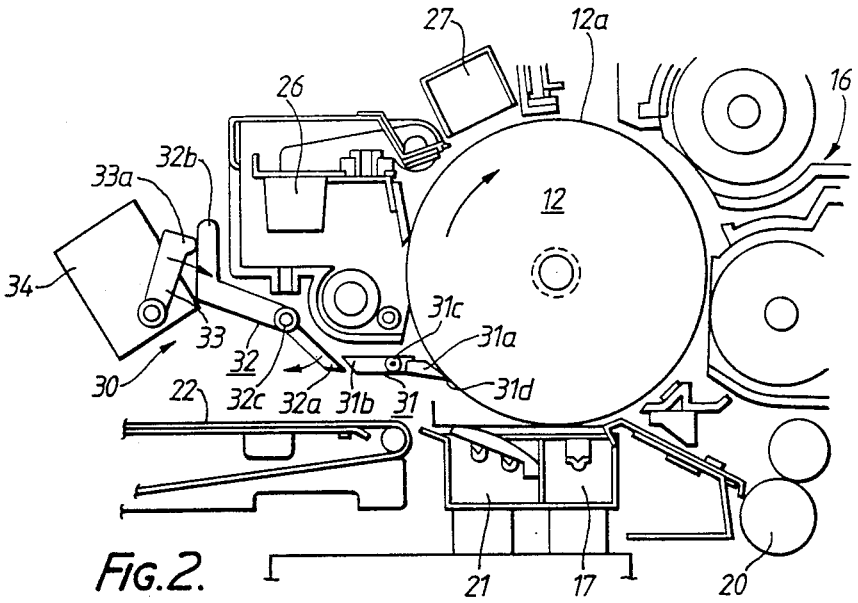
FIGS. 2 and 3 are configurational diagrams showing the operating condition of a separation device.

As shown in FIG. 2, this separation device 30 is constructed in the following manner. A seesaw lever 31 is provided to swingably rotate through a pivot **31*c*. A separating claw 31*a* having a sharp tip 31*d*, is mounted at one end of seesaw lever 31 so that sharp tip 31*d* of claw 31*a* can make contact with a surface 12*a* of photosensitive body 12. The weight of a rear end portion 31*b* at the other end of seesaw lever 31, is slightly heavier than the side of separating claw 31*a***.

Separating claw **31*a* is made of an elastic synthetic resin, such as one of the following materials. These materials include a polyurethane resin, a copolymer of polyurethane resin and silicon system resin, a copolymer of polyurethane resin and fluorocarbon system resin, a dispersed system of polyurethane resin and silicon system resin, or a dispersed system of polyurethane resin and fluorocarbon system resin. Separating claw 31a** *a* s a thickness of 1.5 mm and hardness of 90° in accordance with the JIS (Japan Industrial Standard) for rubber hardness. The hardness of separating claw **31*a*** is measured by a "JIS Hardness Tester" (Shimadzu Co.).

One end portion **32*a* of a rotating link 32 is linked with rear end portion 31*b* of separating claw 31. Rotating link 32 is pivoted with a pivot 32*c* to be swingably rotate through pivot 32*c*. One end portion 33*a* of a rotating lever 33 butts onto the other end 32*b* of rotating link 32. A solenoid 34 rotates rotating lever 33**.

Figure 3:
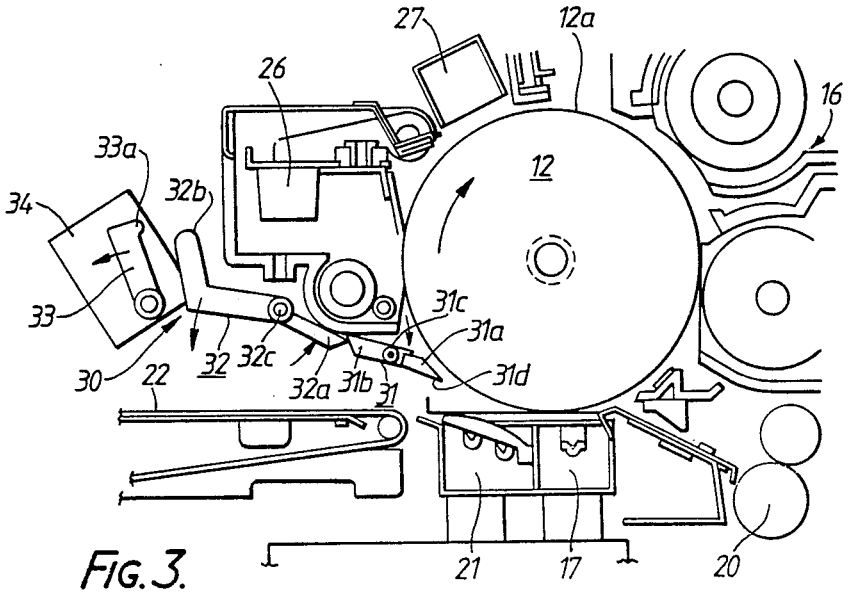

Separation device 30 is designed so that, as shown by the solid line arrow signs in FIG. 2, rotating link 32 is rotated by the switching ON of solenoid 34, which causes rotating lever 33 to perform a pushing action. By this pushing action, one end portion **32*a* of rotating link 32, which is in contact with rear end portion 31*b* of seesaw lever 31 permits seesaw lever 31 to rotate under the weight of rear end portion 31*b*. By this means, sharp tip 31*d* of separating claw 31*a* makes contact with the surface 12*a* of photosensitive body 12. As shown by the solid line arrow signs in FIG. 3, by switching OFF solenoid 34, rotating lever 33 and rotating link 32 are caused to operate in the reverse direction. This causes rear end portion 31*b* of seesaw lever 31 to be pushed upward against the weight of rear end portion 31*b*. Thus, sharp tip 31*d* of separating claw 31*a* is released, so that it is caused to separate from the surface 12*a* of photosensitive body 12**.

Figure 4:
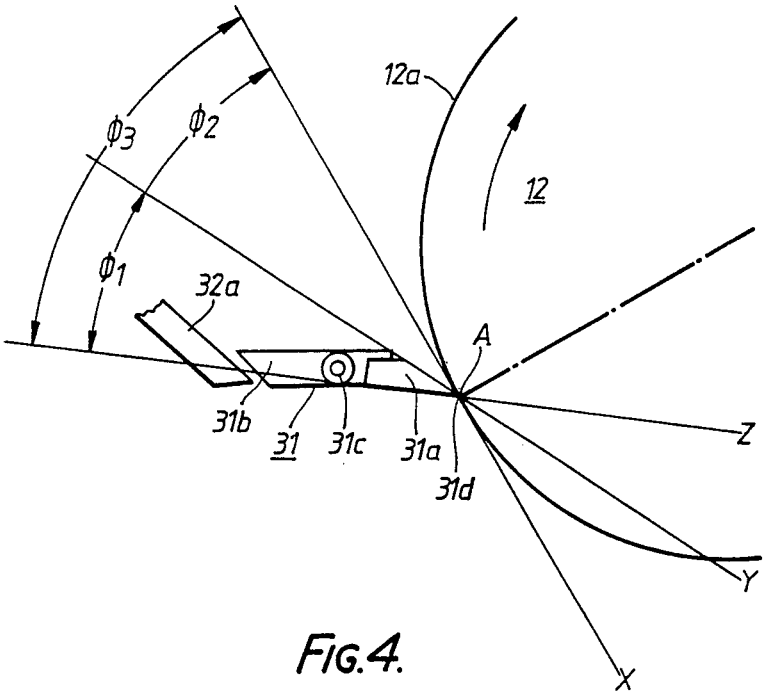
FIG. 4 is a schematic diaagram showing the configuration of the separating claw in the separation device.

The configuration of the contact area at any given time during contact of sharp tip **31*d* of separating claw 31*a* with the surface 12*a* of photosensitive body 12 is as shown in FIG. 4. Tangent line X, which passes through the point of initial contact A with the surface 12*a* of photosensitive body 12**, is taken as reference line. This point of contact A is used as a fulcrum. The two surfaces of separating claw 31*a* are enveloped by the angle $\phi 1$ formed by two lines Y and Z. Two lines Y and Z pass through the fulcrum and form angles $\phi 2$ of 220° and $\phi 3$ of 60°, respectively, from reference tangent line X in the reverse direction to the direction of rotation of photosensitive body 12. The angle $\phi 1$ formed by the two surfaces of separating claw 31*a* is determined so that it is an acute angel within the region of 20°–60°, for example 35°. The reason for this is that, within the acute angle region of 0°–20° for angle $\phi 2$, a separating claw 31*a* would lie flat against the surface 12*a* of photosensitive body 12. Thus, copy sheet P would not be separated. On the other hand, if angle $\phi 3$ was 60α or more, the claw would damage photosensitive body 12 by bounding when in contact.

Figure 5:
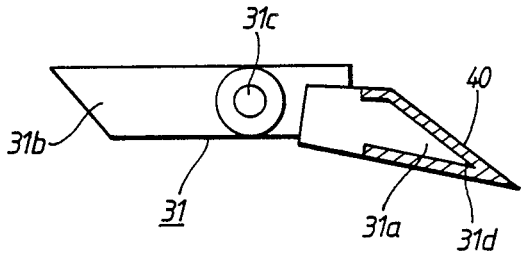
FIG. 5 is a side view showing the tip of the separating claw.

Moreover, at least the surface of sharp tip 31*d* of separating claw 31*a* which comes into contact with the surface 12*a*, as shown by the diagonal shading in FIG. 5, may be covered with a lubricating layer 40 consisting of polytetrafluoroethylene powder with a particle diameter of 2–3 μm when a polyurthane resin is used as the material of separating claw 31*a*. By this means, the coefficient of friction when in contact with the surface 12*a* of photosensitive body 12 can be greatly reduced.

Figure 6:
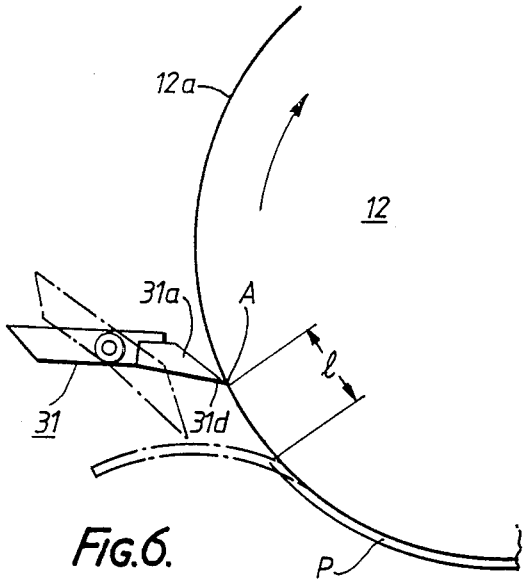
FIG. 6 is a schematic diagram showing the copy sheet separation mechanism.

The timing of the contact of sharp tip 31*d* of separating claw 31*a* with the surface 12*a* of photosensitive body 12 takes as its reference the timing of the commencement of rotation of aligning rollers 20 which transport copy sheet P to the developed image transferring station. When copy sheet P is transported by the rotation of aligning rollers 20, sharp tip 31*d* makes contact by the switching ON of solenoid 34. Solenoid 34 is turned ON after the passage of a time when the front edge of copy sheet P has reached a position approximately 10 mm ("" in FIG. 6) before the point of initial contact A on the surface 12a of photosensitive body 12. After the front edge of copy sheet P has passed through the contact point A, and after a time equivalent to a movement of approximately 10 mm has elapsed, sharp tip 31d of separating claw 31*a* is separated from the surface 12*a* of switching OFF solenoid 34. By this means, the duration of contact of separating claw 31*a* with the surface 12*a* of photosensitive body 12 is shortened to the minimum time required for separation of the copying paper. Thus the probability of the surface 12*a* of photosensitive body 12 being damaged by contact with separating claw 31*a* is even further reduced.

As described above, in the present invention, a separation device is formed by a separating claw having a sharp tip 31d made of an elastic synthetic resin which is caused to make contact with the surface of an image carrier at an appropriate time. For this reason, since the material of the separating claw itself is soft, it does not damage the surface of the image carrier.

Various other modifications could be made in the present invention without departing from the scope or spirit of the following claims.

What is claimed is:

1. An image forming apparatus including a movable image carrier, means for forming an image on the image carrier, and means for transferring the image from the image carrier onto an image bearing sheet while the image bearing sheet is in contact with the surface of the image carrier, the apparatus comprising:

means for separating the image bearing sheet from the image carrier, including a separating claw, the separating claw formed of an elastic synthetic resin composition containing a polyurethane resin; and means for moving the separating claw between a first position in which the tip of the separating claw is in contact with the surface of the image carrier and a second position in which the separating claw is separated from contact with the surface of the image carrier; wherein the synthetic resin tip of the claw contacts both the surface of the image carrier and the image bearing sheet to be separated therefrom.

2. The apparatus of claim 1 wherein the separating claw further includes a lubricating layer on the tip thereof.

3. The apparatus of claim 2 wherein the lubricating layer comprises polytetrafluoroethylene.

4. The apparatus of claim 1 wherein the image carrier includes a rotating photosensitive drum.

5. The apparatus of claim 4 wherein the moving means includes:

a seesaw lever having a middle portion and opposite ends, the lever being movable on a fulcrum at the middle portion of the seesaw lever, the separating claw being mounted at one end of the lever;

a pivotable link having a pivot point centrally located thereon, one end of the link being operatively connected to the other end of the seesaw lever for activating the seesaw lever and moving the separating claw between the first and second position; and a solenoid operatively connected with the other end of link for pivoting the link.

6. An image forming apparatus including a movable image carrier, means for forming an image on the image carrier, and means for transferring the image from the image carrier onto an image bearing sheet while the image bearing sheet is in contact with the surface of the image carrier, the apparatus comprising:

means for separating the image bearing sheet from the image carrier, including a separating claw, the separating claw formed of an elastic synthetic resin composition, said elastic synthetic resin composition including one of a copolymer of a polyurethane resin and a silicon system resin, a copolymer of a polyurethane resin and a fluorocarbon system resin, a dispersed system of a polyurethane resin and a silicon system resin, or a dispersed system of a polyurethane resin and fluorocarbon system resin; and means for moving a separating claw between a first position in which the tip of the separating claw is in contact with the surface of the image carrier and a second position in which the separating claw is separated from contact with the surface of the image carrier; wherein the synthetic resin tip of the claw contacts both the surface of the image carrier and the image bearing sheet to be separated therefrom.

7. An image forming apparatus including a movable image carrier, means for forming an image on the image carrier, and means for transferring the image from the image carrier onto an image bearing sheet while the image bearing sheet is in contact with the surface of the image carrier, the apparatus comprising:

means for separating the image bearing sheet from the image carrier, including a separating claw having a tip for contact with the surface of the image carrier and further including a separation charger between the separating claw and the image transferring means, the separating claw including an elastic synthetic resin composition containing a polyurethane resin; and means for moving the separating claw between a first position in which the tip of the separating claw is in contact with the surface of the image carrier and a second position in which the separating claw is separated from contact with the surface of the image carrier.

8. An image forming apparatus including a movable image carrier, said image carrier being a rotating photosensitive drum, means for forming an image on the image carrier, and means for transferring the image from the image carrier onto an image bearing sheet while the image bearing sheet is in contact with the surface of the image carrier, the apparatus comprising:

means for separating the image bearing sheet from the image carrier, said means including a separating claw having a tip for contact with the surface of the image carrier, said claw including upper and lower surfaces, the upper and lower surfaces being substantially flat and intersecting at the tip, the angle between the tangent to the point of contact of the claw with the surface of the drum and a line along the upper surface of the claw passing through the point of contact at any given time when the claw is in the first position is at least 20 degrees, the separating claw including an elastic synthetic resin composition containing a polyurethane resin; and means for moving the separating claw between a first position in which the tip of the separating claw is in contact with the surface of the image carrier and a second position in which the separating claw is separated from contact with the surface of the image carrier.

9. The apparatus of claim 8 wherein the angle between the tangent to the point of contact of the claw with the surface of the drum and a line along the lower surface of the claw passing through the point of contact at any given time when the claw is in the first position is a maximum of about 60°.

10. The apparatus of claim 8 wherein the angle between the tangent to the point of contact of the claw with the surface of the drum and a line along the lower surface of the claw passing through the point of contact at any given time when the claw is in the first position is a maximum of about 60° degrees.

11. An image forming apparatus including a movable image carrier, means for forming an image on an image carrier, and means for transferring the image from the image carrier onto an image bearing sheet while the image bearing sheet is in contact with the surface of the image carrier, the apparatus comprising:

means for separating the image bearing sheet from the image carrier, including a separating claw having a tip for contact with the surface of the image carrier, the separating claw including an elastic synthetic resin composition containing a polyurethane resin said claw having a hardness of about 90 degrees as measured by a JIS hardness tester; and means for moving a separating claw between a first position in which the tip of the separating claw is in contact with the surface of the image carrier and a second position in which the separating claw is separated from contact with the surface of the image carrier.

* * * * *